US005316433A

United States Patent [19]

Chase

[11] Patent Number: 5,316,433

[45] Date of Patent: May 31, 1994

[54] LOW PROFILE PUSH-PULL SLIPSHEET HANDLER

[75] Inventor: Daniel F. Chase, Longview, Wash.

[73] Assignee: Loron, Inc., Longview, Wash.

[21] Appl. No.: 840,717

[22] Filed: Feb. 21, 1992

[51] Int. Cl.[5] ..... B66F 9/14

[52] U.S. Cl. ..... 414/607; 414/661

[58] Field of Search ..... 414/280, 661, 497, 607, 414/608, 667, 662, 663, 686

[56] References Cited

U.S. PATENT DOCUMENTS

| | | | |
|---|---|---|---|
| 2,576,482 | 11/1951 | Rydner | 414/661 |
| 2,583,977 | 1/1952 | Turner | 414/661 |
| 2,601,932 | 7/1952 | Turner | 414/661 |
| 2,647,649 | 8/1953 | Maynard | 414/661 |
| 2,699,878 | 1/1955 | Avery | 414/661 X |
| 2,818,189 | 12/1957 | Schreck | 414/661 |
| 2,957,594 | 10/1960 | Brenneman | 414/607 |
| 3,180,513 | 4/1965 | Vander Wal | 414/607 |
| 3,640,414 | 2/1972 | Brudi | 414/661 |
| 3,809,264 | 5/1974 | Mayers | 414/608 X |
| 3,885,692 | 5/1975 | Anderson, Jr. | 414/607 X |
| 3,889,833 | 6/1975 | Thomas | 414/607 |
| 4,065,012 | 12/1977 | Rocco | 414/497 X |
| 4,205,938 | 6/1980 | Olson | 414/661 X |
| 4,230,434 | 10/1980 | Seaberg | 414/607 X |
| 4,239,446 | 12/1980 | Vucinic | 414/607 X |
| 4,274,794 | 6/1981 | Olson | 414/661 X |
| 4,300,867 | 11/1981 | Frees | 414/607 X |
| 4,482,286 | 11/1984 | Farmer et al. | 414/607 |
| 4,488,832 | 12/1984 | Kinshofer | 414/607 X |
| 4,619,579 | 10/1986 | Frison | 414/607 |
| 4,708,575 | 11/1987 | Farmer et al. | 414/607 |
| 4,752,179 | 6/1988 | Seaberg | 414/607 |
| 4,764,082 | 8/1988 | Quinn | 414/661 X |
| 4,828,450 | 5/1989 | Adamski et al. | 414/607 |
| 4,861,223 | 8/1989 | Olson | 414/661 |
| 4,890,973 | 1/1990 | Frison et al. | 414/607 |
| 4,902,190 | 2/1990 | House | 414/607 X |
| 4,927,320 | 5/1990 | Olson | 414/661 X |
| 5,022,811 | 6/1991 | Wallmann | 414/661 X |

FOREIGN PATENT DOCUMENTS

| | | | |
|---|---|---|---|
| 764983 | 1/1957 | United Kingdom | 414/607 |

OTHER PUBLICATIONS

Brudi brochure, *Challenger Push Pull Quick-mount Versatility for Palletless Handling*, 3 pages, Feb. 1990.

Brudi specifications, Push-Pull, Pusher, 3 paes.

Cascade Model 45E Push/Pulls specifications, 2 pages.

*Primary Examiner*—David A. Bucci

*Attorney, Agent, or Firm*—Klarquist, Sparkman, Campbell, Leigh & Whinston

[57] ABSTRACT

A push-pull slipsheet handler is attachable to a conventional forklift truck and includes a push-plate assembly mounted to slide over a platen. A push-plate mounted to the assembly may be raised and lowered so that its lower edge may capture and grip a slipsheet edge with a lower leading edge of the push-plate assembly. A single motor mounted to the assembly engages a chain fixed at each of its ends to a base end and free end of the platen, respectively. The apparatus is mounted to a forklift with the forks below the platen for support, and with L-shaped locks attached to the platen and extending behind the fork uprights to secure the apparatus.

32 Claims, 7 Drawing Sheets 12
126
110
130
120
122
10
106
28
110
28
118
29
12
12
116
114
18
20
118
126
120
130
122
124
106
116
114
12
132
120

LOW PROFILE PUSH-PULL SLIPSHEET HANDLER

TECHNICAL FIELD

This invention relates to material handling equipment and more particularly to push-pull attachments attachable to forklift vehicles for handling slip-sheeted loads.

BACKGROUND OF THE ART

Slipsheets are used as an alternative to conventional wooden pallets for carrying and transporting loads of stacked boxed packages. Slipsheets are employed to reduce the cost of transporting the substantial weight and volume of wooden pallets. Slipsheets also cost less and are more readily returned for reuse. While a conventional pallet provides a rigid base and may be lifted by the forks of a conventional forklift vehicle, a slip-sheeted load requires a lifting vehicle having a rigid, flat platen with sufficient area to support the entire load.

A slipsheet handler also picks up a slip-sheeted load differently than a conventional forklift truck that picks up a palleted load. Because the slip-sheeted load rests directly on the ground, the platen may not easily be slipped underneath the load without pushing or toppling the load. Therefore, conventional slipsheet handlers such as described in U.S. Pat. No. 3,640,414 to Brudi use a gripping jaw that is extendable to the leading edge of the platen to grip a peripheral edge tab of the slipsheet. The gripping jaw may be forcefully closed and withdrawn to pull the load onto the platen for transporting.

To unload the slipsheeted load from the platen, an extendable and retractable vertical push-plate (to which the gripping jaw is generally attached) pushes the load off the platen.

Conventional slipsheet handling apparatus have several disadvantages. First, the large push-plate necessarily employed limits the visibility of the operator, reducing safety and efficiency. As shown in the prior art, the push-plate is actuated by a hydraulically-driven pantograph having pantograph arms with lengths proportionate to the horizontal travel of the push-plate. The pantograph arms extend to a substantial height when the push-plate is retracted, partially obscuring the operator's view. In addition, because the pantograph arms must attach to the push-plate, the push-plate itself must extend to a substantial height, further impairing visibility.

A second disadvantage of the prior art apparatus is that the push-plate tends to damage the load it is pushing. The lower edge of the push-plate is spaced above the platen, and tends to cut into the sides of boxed loads. The gap between the platen and the push-plate is necessary to receive the slipsheet edge tab for proper gripping jaw operation. When pushing a load from the platen, the lower push-plate edge remains spaced above the platen, where it may cause undesirable creasing or rupture of delicate boxed loads.

A third disadvantage of the prior art apparatus is the substantial cost, weight and power loss associated with the several hydraulic cylinders and required sequencer to control the operation of the cylinders, as well as the overall size of the structural components required.

SUMMARY OF THE INVENTION

The primary objects of the invention are to provide:

- a push-pull slipsheet loading apparatus that overcomes the aforementioned disadvantages of the prior art;
- a push-pull apparatus as aforesaid in which the apparatus provides improved operator visibility in that the apparatus does not obscure the operator's forward view;
- a push-pull apparatus as aforesaid having a push-plate that will not damage the load being handled because the lower edge of the push-plate is substantially adjacent the platen surface when a load is being pushed;
- an apparatus as aforesaid having lower power requirements than prior push-pull apparatus; it being powered and controlled by a single motor not requiring hydraulic cylinders or sequencers;
- an apparatus as aforesaid in which the overall weight and complexity of the apparatus is reduced to accommodate larger loads at a reduced cost; and
- an apparatus as aforesaid having greater versatility than prior push-pull apparatus in being adapted for use as an attachment to existing forklift trucks, as a stand-alone "walkie" or as part of a dedicated vehicle.

According to the illustrated embodiment of the present invention, the primary objects are achieved by providing a push-pull slipsheet handler having a fork-supported platen, a low-profile push-plate assembly moveable relative to the platen, and a low-profile driver carried by the push-plate assembly and operably connected to the frame of the attachment to extend and retract the assembly. The push-plate assembly includes a push-plate that is automatically raised and lowered to grip a slipsheet between its lower edge and a lower jaw of the assembly, with the mechanical interaction of the driver and the push-plate assembly causing gripping of the slipsheet when the push-plate is being retracted.

The foregoing and additional features and advantages of the present invention will be more readily apparent from the following detailed description which proceeds with reference to the accompanying drawings.

DETAILED DESCRIPTION OF A PREFERRED EMBODIMENT

Figure 1:
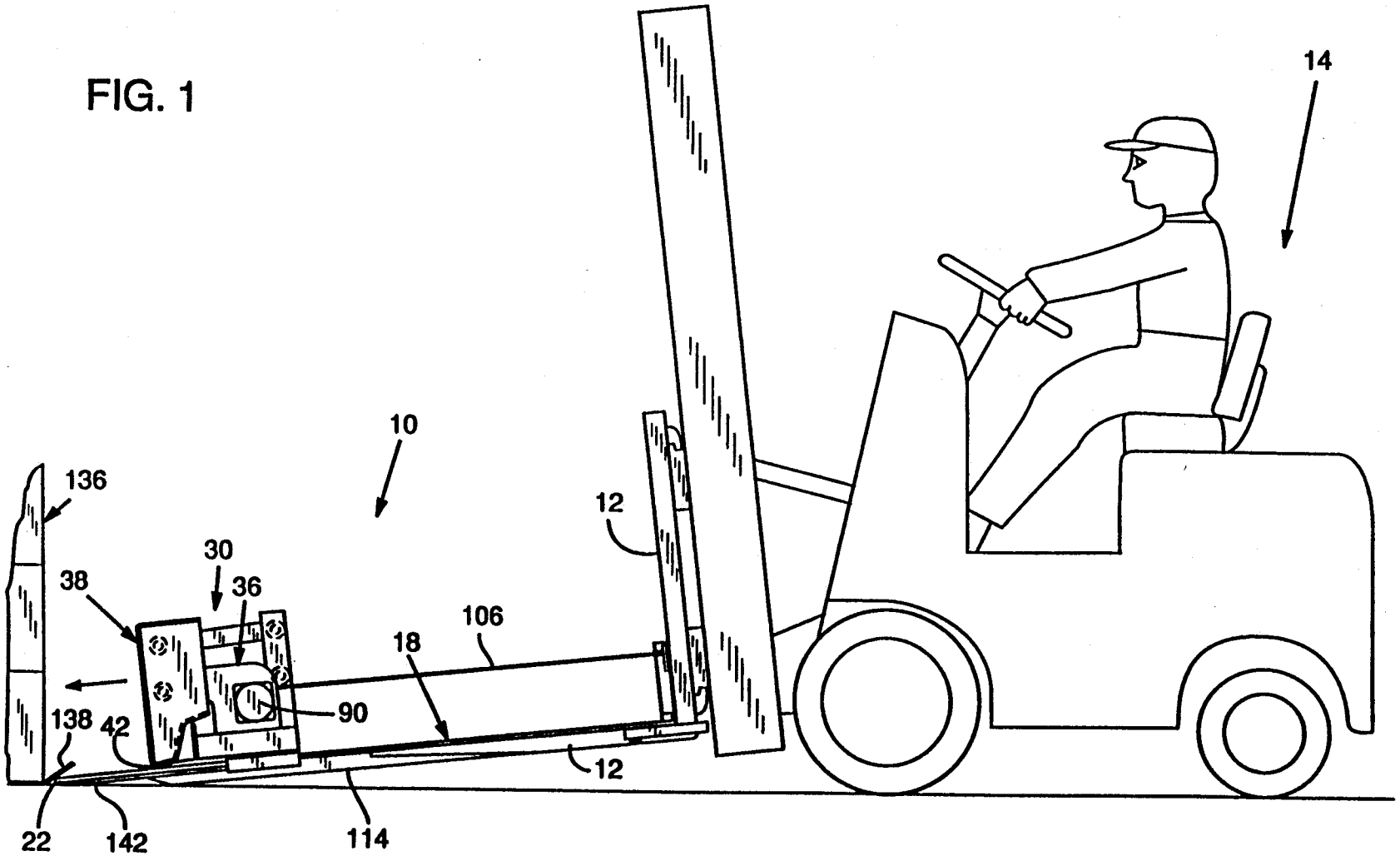
FIG. 1 is a side view of an apparatus according to the present invention as installed on a conventional forklift truck.

FIG. 1 shows a push-pull apparatus 10 attached to a pair of forks 12 of a conventional forklift vehicle 14. In the preferred embodiment illustrated, the apparatus 10 is a demountable accessory. Alternatively, the apparatus 10 may be included as a permanent part of a dedicated slipsheet handler vehicle.

Figure 2:
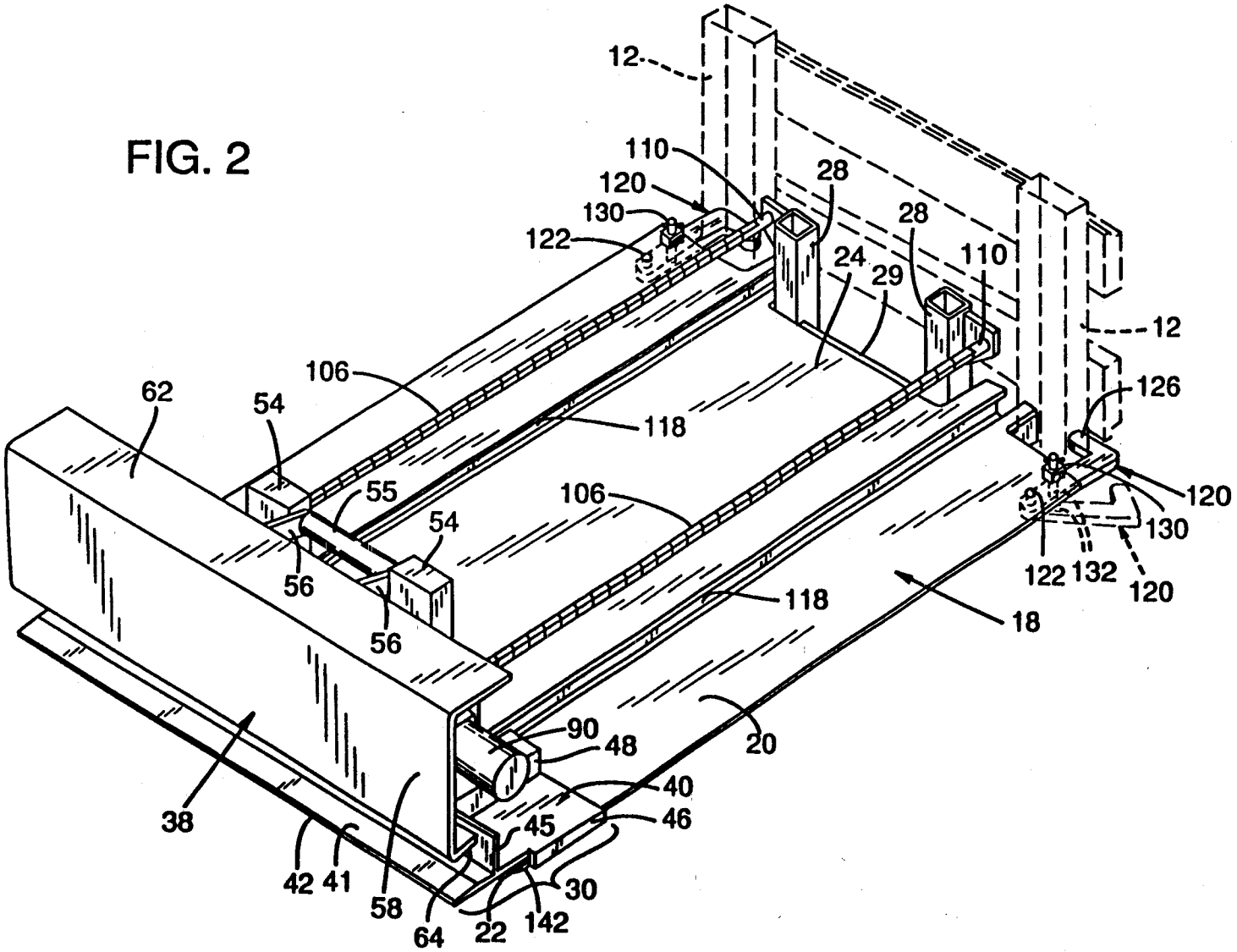
FIG. 2 is a perspective view of the apparatus of FIG. 1 as viewed from above and one side looking toward the rear.

FIGS. 1 and 2 show the push-pull apparatus 10 having a platen 18 supported by the forks 12 for bearing a load 136. A motorized push-plate assembly 30 having a vertically movable push-plate 38 slides over the platen 18 with the push-plate 38 serving to push the load 136 from the platen, or to clamp downward onto a slip sheet edge 138 to pull the load onto the platen. The push-plate assembly 30 includes a motor carriage assembly 36 that moves horizontally relative to the push-plate 38 to control the vertical movement of the push-plate 38, and which carries a motor 90 that engages a roller chain 106 extending from front to rear above the platen to move the push-plate assembly 30 over the platen.

The platen 18 has a flat upper surface 20 in a generally horizontal plane. The platen is generally rectangular with a leading free end 22 and an opposed base end 24 adjacent the vehicle 14 (shown in FIG. 1). A pair of spaced-apart vertical stanchions 28 are connected at their bases by a cross bar 29 to form a U-shaped assembly which is attached to the base end 24 of the platen 18 so that the stanchions 28 project rigidly upward therefrom, as best shown in FIG. 5.

Figure 5:
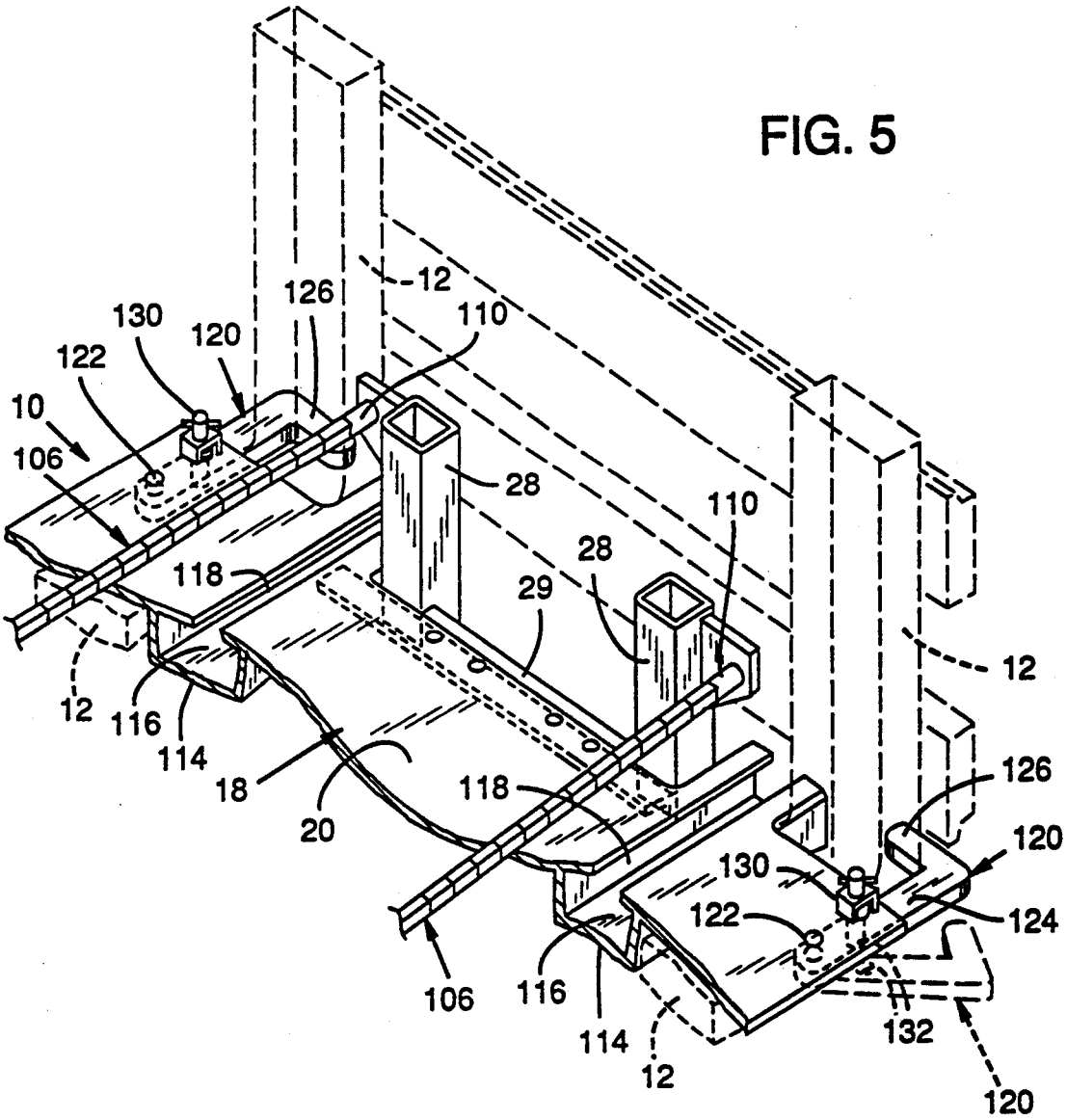
FIG. 5 is a perspective fragmentary view of a rear portion of the apparatus of FIG. 1 showing its attachment to the lift truck forks as viewed from above and one side looking rearward.

As further shown in FIG. 5, the horizontal portions of the forks extend beneath the platen 18 outboard of a pair of chain-receiving channels 114. Each channel 114 defines an elongated rectangular space 116 beneath the platen upper surface 20, which is interrupted to provide access to the full length of each space 116 through an elongated slot 118 formed in the platen upper surface 20 above each channel 114. Each slot 118 is sufficiently wide, and the space 116 sufficiently deep so that the chain 106 may be received therein without protruding above the upper surface 20 of the platen 18.

Near the leading edge 22 of the platen 18, a platen stop 142 is attached to protrude below the lower surface of the platen at each lateral edge thereof.

Figure 6A:
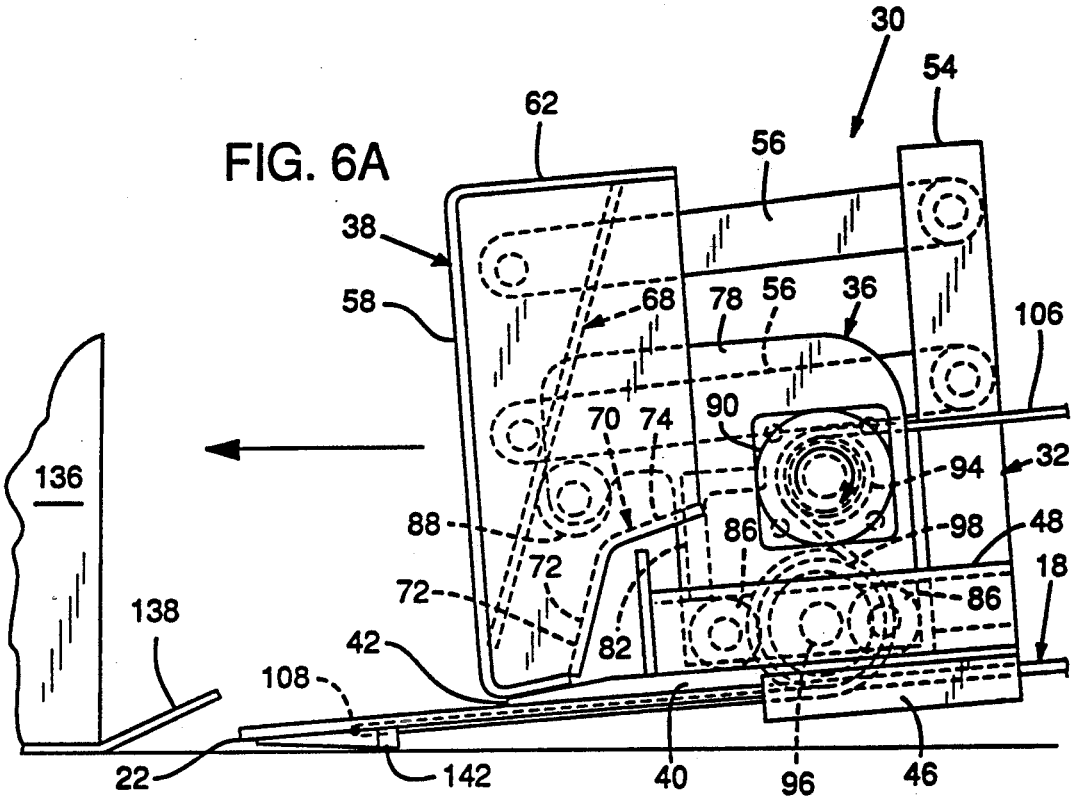
FIGS. 6A–6D are schematic side views of the apparatus of FIG. 1 illustrating the sequence of operation.

The push-plate assembly 30 is driven by the motor between an extended position, with the push-plate assembly 30 at the free end 22 of the platen, and a retracted position (not shown) with the assembly 30 at the base end 24 of the platen. Intermediate positions are shown in FIGS. 1 and 6A.

Figure 3:
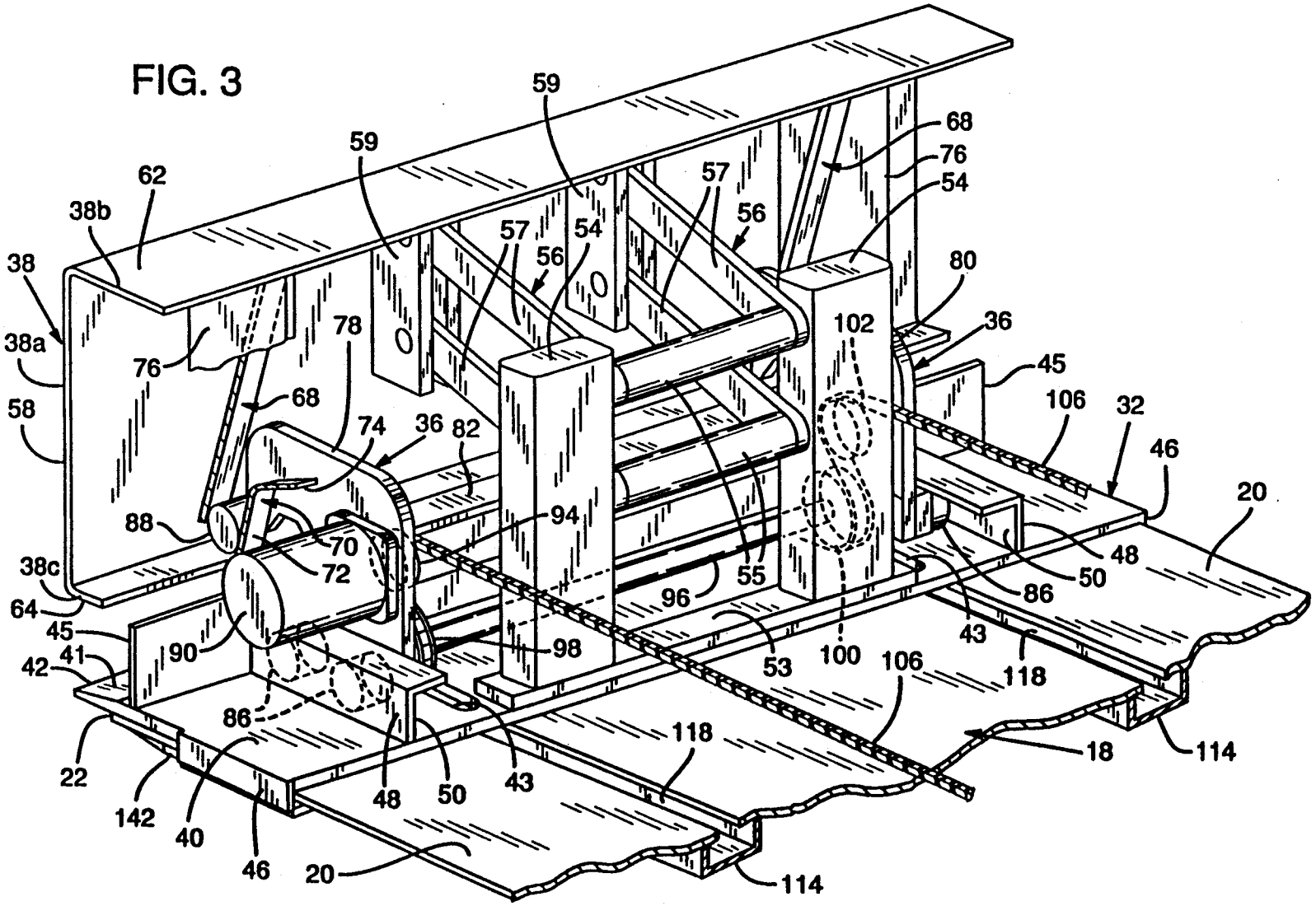
FIG. 3 is a detailed perspective view of the apparatus of FIG. 1 as viewed from behind and one side.

As shown in FIG. 3, the push-plate assembly 30 includes a rigid sliding chassis 32, with the motor carriage assembly 36 mounted for limited horizontal movement relative to the sliding chassis 32. The generally U-shaped push-plate 38 is pivotally mounted to the chassis 32 for generally vertical movement. The push-plate 38 includes a generally vertical main plate portion 38*a* having upper and lower flange portions 38*b* and 38*c* extending rearward from its upper and lower edges.

Figure 6B:
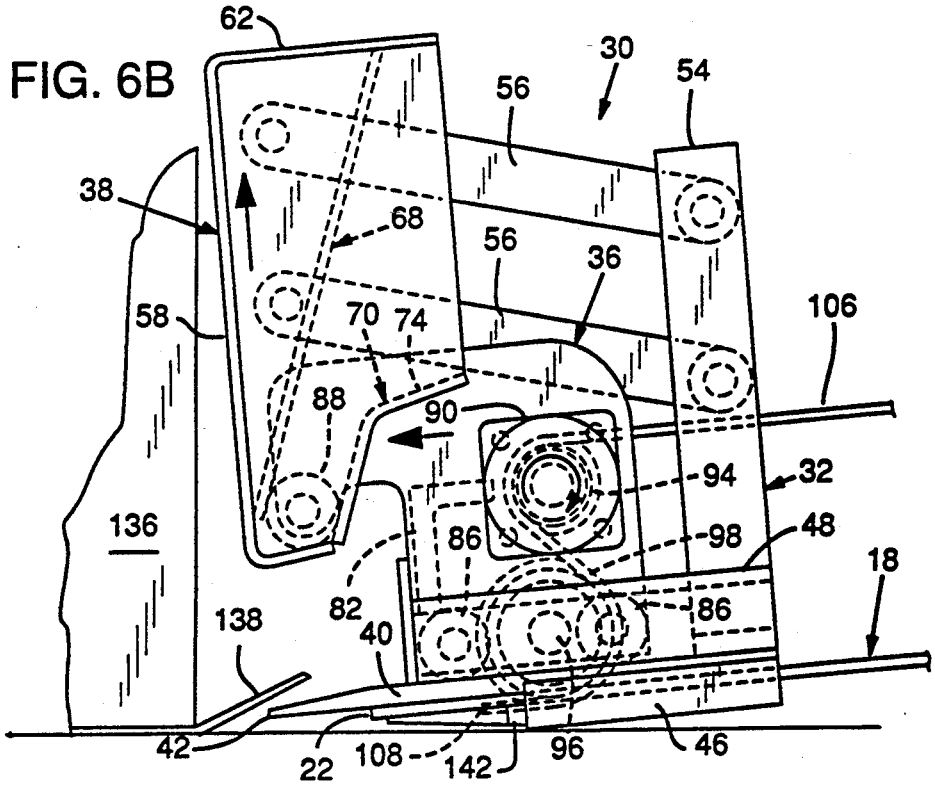

The sliding chassis 32 includes a rigid chassis base plate 40 that slides atop the upper surface 20 of the platen 18. The base plate 40 includes tapered section 41 terminating at a leading edge 42 corresponding to the free end 22 of the platen. A pair of chassis slots 43 are defined through the base plate 40 and are registered with the elongated slots 118 of the platen 18. The chassis slots are sufficiently wide to permit passage of the roller chain 106, and sufficiently long to permit clearance over the entire range of motion of the motor carriage assembly 36. A pair of inwardly-oriented, L-shaped platen guides 46 depend from opposed side edges 44 of the base plate 40 extending beside and beneath the platen to capture it, thereby constraining the push-plate assembly only to linear motion between the extended and retracted positions. The platen guides are arranged to contact the platen stops 142 to limit the forward travel of the push-plate assembly 30, as shown in FIG. 6B. A pair of inwardly-oriented L-shaped wheel guides 48 are attached to the upper side of the chassis plate 32 to form a corresponding pair of inwardly-open opposed rectangular guide tracks 50. A pair of rigid vertical upright members 54 projects upwardly from a horizontal reinforcing bar 53 attached to the base plate 40, the uprights 54 positioned at symmetrically opposed positions inward of the wheel guides 48. A vertical stop plate 45 projects upward from the base plate 40, immediately rearward of the tapered section 41 and forward of the guide tracks 50 to reinforce the assembly and to provide a stop for a slip sheet edge.

The push-plate 38 is attached to the upright members 54 by a pair of pivotable U-shaped linkage elements 56 arranged to form a parallel four-bar linkage. Each U-shaped element 56 has a horizontal base bar 55 that spans between the upright members 54 and is pivotally attached thereto. A pair of parallel legs 57 project forwardly from respective ends of each base bar 55 and are pivotally attached at their forward ends to a pair of reinforcing channels 59 attached to the rear of the main push-plate portion 38*a*.

The main push-plate 38*a* remains generally vertical as the push-plate 38 is shifted through its range of substantially vertical pivoting motion. The push-plate upper flange portion 38*b* further includes a horizontal upper surface 62. The lower flange portion 38*c* includes a downward-facing lower push-plate surface 64 in opposed parallel relation with and immediately above the tapered portion 41 of the chassis base plate 40. The tapered portion 41 of the base plate and the lower push-plate surface 64 form the lower and upper clamping jaws, respectively, for gripping a slipsheet with a downward force generated selectively during operation.

The push-plate 38 further includes a pair of primary ramps 68 positioned on the rear surface of the push-plate to slope upwardly and rearwardly by an angle between about 10 to 40 degrees from the vertical, with 20 degrees being preferable. Each of a pair of secondary ramps 70 includes a first upwardly and rearwardly sloped portion 72 generally parallel to and spaced behind one of the primary ramps 68, extending upwardly from the trailing edge of the push-plate lower flange portion 38*c*. A second portion 74 of each secondary ramp 70 extends generally upwardly and rearwardly from the upper end of each first portion 72 at an angle of about 15 degrees from horizontal. A pair of web plates 76 is attached perpendicularly to the push-plate, spanning the space between the upper flange 38*b* and the lower flange 38*c* to provide structural rigidity. Each web plate 76 is positioned outboard of and adjacent one of the ramps 68. The ramps 68, 70 are attached to the web plates to provide additional structural rigidity.

Figure 4:
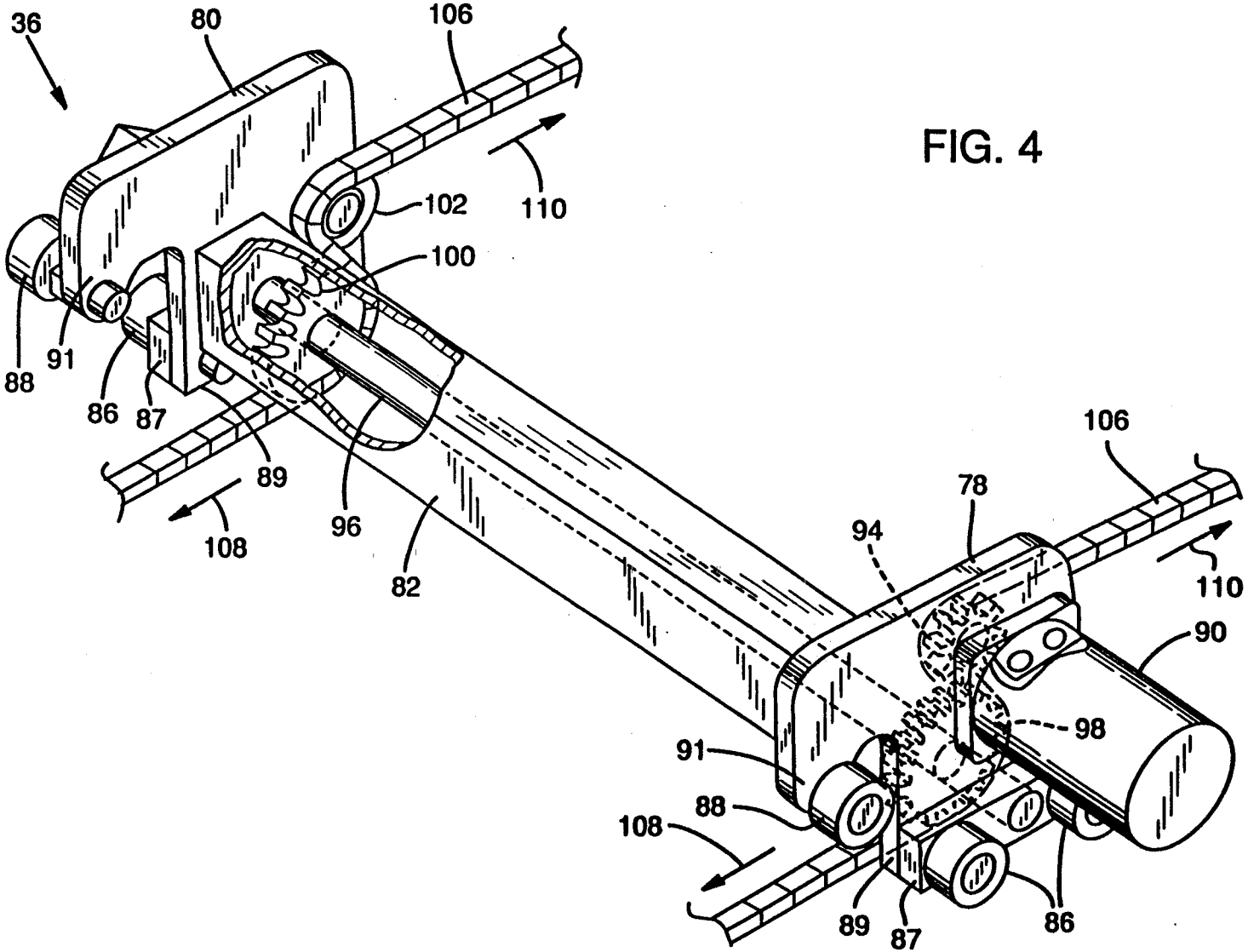
FIG. 4 is a perspective view of the motor carriage assembly portion of the apparatus of FIG. 1 as viewed from above and to one side looking rearward.

FIG. 4 shows the motor carriage assembly 36 removed from the push-plate assembly. The motor carriage assembly 36 includes a first carriage plate 78 and a second carriage plate 80. The carriage plates are parallel, vertically oriented and rigidly interconnected by an elongated beam 82 having an L-shaped cross-section (as shown in FIGS. 6A–6D) so that the carriage plates are spaced apart to fit closely within the gap formed by the wheel guides 48 (FIG. 3). Each carriage plate includes a pair of guide wheels 86 protruding distally outward from a reinforcing bar 87 attached at an outboard lower portion of the carriage plates 78, 80. The wheels 86 are rotatable on axes parallel to the elongated beam 82, and are sized to fit within the guide tracks 50 (FIG. 3) without excessive play to permit the motor carriage assembly 36 to extend and retract within a limited range relative to the sliding chassis 32 (FIG. 3). The axes of the wheels 86 are located sufficiently near a lower edge 89 of each carriage plate 78, 80 and the wheels have a sufficient diameter so that the wheels extend below the plates to roll on the upper surface of the chassis base plate 40.

At an intermediate height on each carriage plate 78, 80, from a leading nose portion 91 thereof, a push-plate actuator wheel 88 protrudes distally outward, similarly to the guide wheels 86. The actuator wheels 88 are spaced apart and configured to interact with the primary ramps 68 on the push-plate 38 (shown in FIG. 3). The actuator wheels 88 function by pressing horizontally against the ramps 68 to elevate the push-plate when the motor carriage assembly is extended relative to the sliding chassis 32. When the motor carriage assembly 36 is retracted, the actuator wheels ride atop the second portions 74 of the secondary ramps 70 to force the push-plate downward, thus driving the lower push-plate surface 64 against the tapered portion 41 of the base plate 40 to clamp a slipsheet edge.

A motor 90 serving as the sole driver of vertical motion of the push-plate 38 and horizontal motion push-plate assembly 30 is mounted to the first carriage plate 78 to drive directly a first drive sprocket 94 mounted inwardly of the first carriage plate 78 on an axis parallel to the beam 82. A transverse drive shaft 96 extends between the carriage plates. A second drive sprocket 98 is mounted to the shaft 96 in planar alignment with the first drive sprocket 94. A third drive sprocket 100 is mounted to the shaft 96 opposite the second drive sprocket 98, and adjacent the second carriage plate 80. An idler sprocket 102 is rotatably mounted to the second carriage plate 80 in a position opposite to the first drive sprocket 94 and in planar alignment with the third drive sprocket 100.

The pair of drive chains 106 serve as engagement members that drivingly engage the sprockets so that operation of the motor 90 drives the motor carriage assembly 36 and the entire push-plate assembly 30 relative to the platen 18. Each chain includes a forward end 108 and a rearward end 110, and is positioned adjacent a carriage plate, with the chain corresponding to the first carriage plate 78 extending horizontally from its rearward end 110 to interact with the sprockets. The chain passes in an S-shaped curve over and in front of the first drive sprocket 94, behind and below the second drive sprocket 98 and continues downward through the elongated slot 118 in the platen (FIG. 3), and horizontally forward through the space 116 defined by the channel 114 to the forward end 108, which is secured within the channel 114 near the platen leading edge 22, as shown in FIGS. 6A–6D. The rearward end 110 is attached to the upper end of the stanchion 28, as shown in FIG. 5. Similarly, the chain corresponding to the second carriage plate 80 extends over and forward of the idler sprocket 102, passing behind and below the third drive sprocket 100.

The transverse drive shaft 96 provides synchronized operation on both chains 106. Operation of the motor 90 creates tension in the chains and rotates the first drive sprocket 94 to draw the chain 106 over the second drive sprocket 98, which drives the shaft 96, thereby driving the third drive sprocket 100. The third drive sprocket acts on the second chain with a synchronized rotation to ensure that the motor carriage assembly is maintained in its original orientation perpendicular to its direction of motion. This is achieved with only a single motor because of the transmission of forces between the chains by the shaft 96.

As shown in FIG. 5, the apparatus 10 is secured to the forks 12 by a pair of opposed pivoting L-shaped retainer locks 120. Each lock 120 is attached to the platen 118 at a rearward corner pivot 122 to permit the lock to pivot about a vertical axis. Each retainer lock 120 includes a first portion 124 extending radially from the pivot 122, and a second portion 126 extending at a right angle to the first portion 124 at a distal end thereof. The second portion 126 is positionable in a locked position, as shown, immediately behind an upright portion of the fork 12 to prevent the apparatus 10 from being removed from the forks 12. To secure the retainer lock 120 in the locked position, a spring-loaded latch 130 mounted to the upper surface 20 of the platen 18 engages a latch hole 132 defined at an intermediate position on the first portion 126 of each lock 120. The latch 130 may be released when the apparatus is to be removed from the forks by pivoting the locks to the released position shown in dashed lines.

OPERATION

FIGS. 6A through 6D illustrate the process by which the apparatus 10 approaches a slipsheeted load 136, grabs the slipsheet tab 138, draws the load onto the platen for transport and pushes the load from the platen.

In FIG. 6A, the vehicle has approached the load and positioned the leading end 22 of the platen 18 near the tab 138. The motor carriage assembly 36 is driven to advance the push-plate assembly 30 toward an extended position. In doing so, the push-plate actuator wheels 88 contact the ramps 68 to drive forward the entire assembly 30. The push-plate remains in the lowered position because the ramps 68 are sufficiently near the vertical that the weight of the push-plate overcomes its tendency to rise upward caused by the frictional forces resisting motion of the push-plate assembly 30 over the platen 18.

As shown in FIG. 6B, when the platen guides 46 contact the platen stop 142, the sliding chassis 32 may advance no further. The motor carriage 36, however, continues to advance forward relative to the sliding chassis 32 due to the continued operation of the motor 90. This creates a substantial horizontal force by the actuator wheels 88 against the ramps 68, which is sufficient to overcome the weight of the push-plate 38, thereby raising the push-plate to the raised position shown in FIG. 6B. With the push-plate in the raised position, the gripping jaw formed by the lower edge of the push-plate and the tapered portion 41 of the base plate 40 is fully opened so that the vehicle operator may position the jaw to receive the tab 138. With the tab in position, the operator reverses the drive motor 90.

Figure 6C:
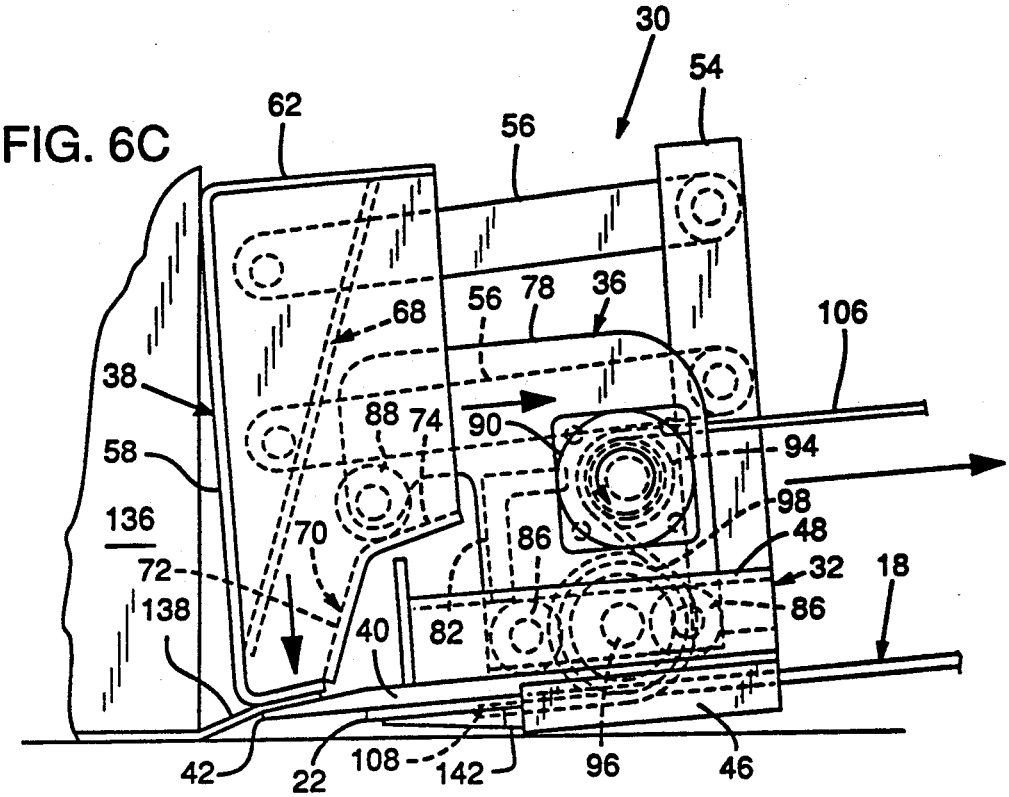

As shown in FIG. 6C, reverse operation of the motor causes the motor carriage assembly 36 to shift rearwardly relative to the sliding chassis 32, thereby allowing the push-plate 38 to lower onto the slipsheet tab 138. As the motor carriage assembly 36 further withdraws from the push-plate, the actuator wheels 88 encounter the second portions 74 of the secondary ramps 70, forcing the push-plate downward to grip the slipsheet tab 138 with a force that is proportionate to the horizontal force pulling the load 136 onto the platen 18. Any increase in frictional force caused by heavier loads or higher friction surface conditions is compensated for by the proportionately increased gripping force.

Figure 6D:
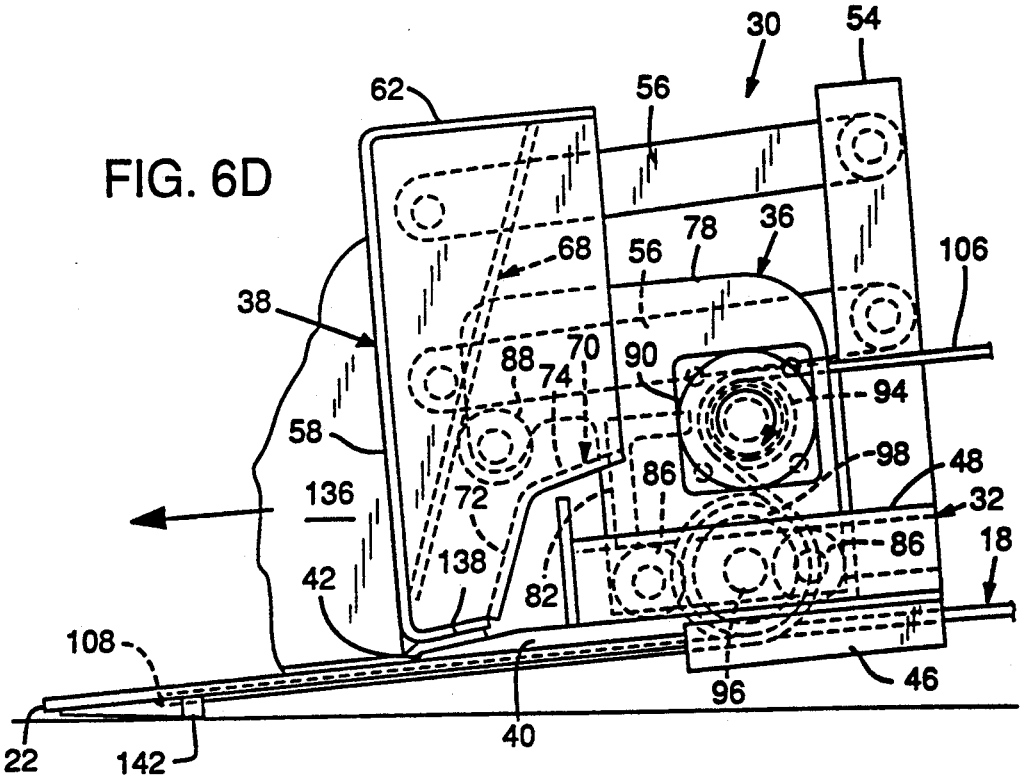

After the load is fully drawn onto the platen, it may be transported to a desired location. To eject the load, as shown in FIG. 6D, the motor 90 is driven to advance the motor carriage assembly 36 forward relative to the sliding chassis 32 until the push-plate actuator wheel 88 contacts the ramp 68. Consequently, the entire assembly advances until the load 136 is contacted by the push-plate 38, with the push-plate remaining in the lowered position. The weight of the push-plate 38 and its frictional interaction with the side of the load prevent the push-plate from rising as the load is being pushed.

EXAMPLE

In a preferred embodiment, the platen is 40 inches wide by 48 inches long and formed of A36 steel having a typical thickness of 0.25 inches. The motor is a hydraulic motor rated at 6 horsepower, such as Model No. 101-1760 produced by Char-Lynn. The push-plate is 12 inches high and extends the full width of the platen. The ramp 68 is angled 20 degrees from the vertical and the second portion 74 of the secondary ramp 70 is angled 13 degrees from the horizontal. The chain 106 is a conventional No. 40 size roller chain.

Having illustrated and described the principles of the invention by what is presently a preferred embodiment, it should be apparent to those skilled in the art that the illustrated embodiment may be modified without departing from such principles. For instance, the motor may be a conventional electric motor, and the push-pull apparatus may be included on a dedicated push-pull vehicle, instead of as a retrofit accessory for a conventional forklift vehicle.

I claim as my invention not only the illustrated embodiments, modifications, variations and equivalents thereof as come within the spirit and scope of the following claims:

1. A push-pull slipsheet handler comprising:

a platen having an upwardly facing load carrying surface;

a push plate assembly mounted for movement over the platen between an extended position and a retracted position, the push plate assembly including a forwardly facing push-plate vertically movable relative to the platen between a lowered positioned and a raised position;

a driver carried by the push-plate assembly and actuatable for moving the push-plate assembly between the retracted position and the extended position, the driver being operable to engage the push plate for moving the push plate between the lowered position and the raised position.

2. The apparatus of claim 1 wherein the entire driver is a motor mounted independently of the platen.

3. The apparatus of claim 2 wherein the driver engages an elongated engagement member extending along the platen.

4. The apparatus of claim 3 wherein the engagement member is a chain.

5. The apparatus of claim 1 further comprising attachment means for attaching the handler to a standard fork lift vehicle.

6. The apparatus of claim 5 wherein the attachment means is configured to engage a fork of the forklift vehicle.

7. The apparatus of claim 5 wherein the attachment means is mounted to the platen.

8. The apparatus of claim 1 wherein the push-plate assembly includes:

a clamping jaw movable between an open position and a closed position in response to motion of the push-plate assembly by the driver.

9. The apparatus of claim 8 wherein the push-plate is movable between a raised position and a lowered position and comprises an upper portion of the clamping jaw.

10. The apparatus of claim 9 wherein the clamping jaw includes a lower jaw positioned below the push-plate such that a slipsheet edge may be inserted between the push-plate and the lower jaw when the push-plate is in the raised position, and such that a slipsheet edge between the push-plate and the lower jaw is gripped therebetween to resist removal when the push-plate is in the lowered position.

11. The apparatus of claim 9 wherein the push-plate is operably connected to the driver to provide a gripping force between the push-plate and the lower jaw in response to movement of the push-plate assembly toward the retracted position.

12. The apparatus of claim 9 wherein the push-plate is operably connected to the driver to raise the push-plate to the raised position in response to further actuation of the driver when the push-plate assembly is already in the extended position.

13. The apparatus of claim 3 wherein the driver moves the push-plate assembly by creating a tension force on the engagement member.

14. The apparatus of claim 1 wherein the driver comprises a hydraulic motor movable with the push-plate assembly.

15. A push-pull slipsheet handler comprising:

a platen having a base end and a free end;

a push-plate assembly mounted to the platen for relative movement over the platen, the push-plate assembly including a forward-facing push-plate that is vertically movable relative to the platen;

push-plate advancing means actuatable for moving the push-plate assembly away from the base end;

push-plate retracting means actuatable for moving the push-plate assembly toward the base end; and slipsheet gripping means for selectably capturing and clamping a slip sheet edge.

16. The apparatus of claim 15 wherein the slipsheet gripping means includes a lower jaw in substantially fixed vertical relation with the platen.

17. The apparatus of claim 15 wherein the slipsheet gripping means includes a lower portion of the push-plate.

18. The apparatus of claim 15 wherein the slipsheet gripping means is configured to maintain the push-plate in a lowered position proximate to the platen in response to motion of the push-plate away from the base end, such that a lower edge of the push-plate does not make damaging contact with an intermediate height position on a load.

19. The apparatus of claim 18 wherein the push-plate in the lowered position is spaced apart from the platen by less than 0.25 inches.

20. The apparatus of claim 15 wherein the push-plate advancing means moves the push-plate to a raised position in response to actuation of the push-plate advancing means while the push-plate is fully spaced apart from the base end.

21. The apparatus of claim 15 wherein the push-plate retracting means moves the push-plate to a lowered position in response to actuation of the push-plate retracting means.

22. The apparatus of claim 15 wherein the slipsheet gripping means retains a slipsheet with a compressive slipsheet gripping force in response to movement of the push-plate toward the base end.

23. The apparatus of claim 22 wherein the slipsheet gripping means increases the slipsheet gripping force in proportion to a resistant force required to retract the push-plate toward the base end, such that the slipsheet is retained while pulling any of a wide range of slipsheeted load weights.

24. The apparatus of claim 15 wherein the handler is attachable to a standard forklift vehicle.

25. The apparatus of claim 24 further comprising an attachment element mounted to the platen.

26. The apparatus of claim 25 wherein the attachment element engages the rear of an upright portion of the vehicle fork.

27. A push pull slipsheet handler comprising:

a platen having an upwardly facing load carrying surface;

a push-plate assembly mounted for relative movement over the platen, the push-plate assembly including a push-plate that is vertically movable relative to the platen;

a driver carriage carried by the push-plate assembly and movable relative to the push-plate assembly between a first position and a second position, the driver carriage including a.mechanism operable in response to movement of the driver carriage toward the first position to elevate the push plate; and attachment means mounted on the platen for attaching the handler to a standard forklift vehicle.

28. The handler of claim 27 wherein the attachment means comprises a fork-engaging member for selectably engaging a portion of the forklift vehicle fork.

29. The handler of claim 28 wherein the attachment means engages a rearward facing surface of an upright portion of the fork.

30. The handler of claim 27 wherein the attachment means is pivotally attached to the platen.

31. The handler of claim 29 wherein the attachment means comprises an L-shaped member having a first portion extending rearwardly from the platen and a second portion extending along the rear surface of the fork.

32. A push-plate slipsheet handler apparatus comprising:

a platen having an upper surface for supporting a load;

a push-plate assembly mounted for movement between extended and retracted positions along the platen;

said assembly including a push-plate above said upper surface and mounted for generally vertical movement relative to the platen between a raised position and a lowered position;

said assembly including upper and lower slipsheet gripping jaws movable between an open position and a closed position, a lower portion of the push-plate comprising the upper jaw; and a driver on the assembly operable to (1) move the assembly between said extended and retracted positions; (2) raise the push-plate to the raised position upon operation to move the assembly toward its extended position when the assembly is already in its extended position; and (3) move the gripping jaws to the closed position upon operation to move the assembly toward its retracted position.

* * * * *